US005381562A

United States Patent [19]

Holloway et al.

[11] Patent Number: 5,381,562

[45] Date of Patent: Jan. 17, 1995

[54] CONTOURED BASIN

[75] Inventors: Joan M. Holloway, Louisville, Ky.; Jeter L. Ridley, Moscow, Tenn.

[73] Assignee: Vollrath Group, Inc., Gallaway, Tenn.

[21] Appl. No.: 3,965

[22] Filed: Jan. 15, 1993

[51] Int. Cl.[6] ..... A45D 19/06

[52] U.S. Cl. ..... 4/516; 4/519; 4/523; 4/621

[58] Field of Search ..... 4/515, 516, 517, 519, 4/520, 521, 523, 621, 619, 641, 650, 640, 639, 656, 572.1; 607/84, 85, 86

[56] References Cited

U.S. PATENT DOCUMENTS

| | | | |
|---|---|---|---|
| D. 221,768 | 9/1971 | Sevedra | 4/572.1 |
| 233,674 | 10/1880 | Hayes et al. | 4/656 |
| 452,131 | 5/1891 | Haughawout | 604/289 |
| 508,885 | 11/1893 | Johnston | 4/656 |
| 747,525 | 12/1903 | Willis | 604/289 |
| 1,105,365 | 7/1914 | McQuhae | 4/173 |
| 1,797,777 | 3/1931 | Krauss | 4/572.1 |
| 1,842,192 | 1/1932 | Patterson | 4/622 |
| 2,041,087 | 4/1936 | Ocasek | 4/621 |
| 2,475,259 | 7/1949 | Singleton | 4/515 |
| 2,486,824 | 11/1949 | Daniels | 4/621 |
| 2,709,435 | 5/1955 | Kress | 4/621 |
| 2,876,459 | 3/1959 | Ackerson | 4/572.1 |
| 3,046,567 | 7/1962 | Jackson | 4/621 |
| 3,083,376 | 4/1963 | Johns | 4/621 |
| 3,288,140 | 11/1966 | McCarthy | 604/289 |
| 3,465,370 | 9/1969 | Chernick | 4/515 |
| 3,545,012 | 12/1970 | Espin | 4/523 |
| 3,611,450 | 10/1971 | Bost | 4/621 |
| 3,733,620 | 5/1973 | Clintz | 4/515 |
| 4,651,361 | 3/1987 | Nolan | 4/516 |
| 5,245,713 | 9/1993 | Tickle | 4/516 |
| 5,261,130 | 11/1993 | Kendall | 4/593 |

FOREIGN PATENT DOCUMENTS

| | | | |
|---|---|---|---|
| 2133283 | 7/1984 | United Kingdom | 4/519 |

*Primary Examiner*—Henry J. Recla
*Assistant Examiner*—Charles R. Eloslway
*Attorney, Agent, or Firm*—Olson & Hierl, Ltd.

[57] ABSTRACT

A portable basin is disclosed which is adapted to receive and support a selected part of a person's body for isolatable cleansing, treatment and the like with minimal discomfort to the person. The disclosed basin is of unitary, continuous sidewall construction having certain body supporting contour features on its bottom and top edge and certain self-stabilizing features. More particularly, a basin of this invention provides an integral elevated platform portion feature in its bottom for receiving and supporting a selected body part during cleansing or treatment within the interior of the basin and at least one seat defined in the top edge of its sidewall contoured for concurrently receiving and supporting an associated member of the selected body part. One disclosed preferred basin embodiment is particularly adapted for cleansing and treating the head of a person. Another disclosed preferred basin embodiment is particularly adapted for also cleansing and treating a limb part of a person and its associated extremities.

37 Claims, 2 Drawing Sheets

CONTOURED BASIN

FIELD OF THE INVENTION

This invention relates generally to basins for use in hospital facilities and other health care facilities. In particular, this invention relates to a portable, contoured basin for holding liquid for cleansing or treating a selected part of a patient's body supported therein.

BACKGROUND OF THE INVENTION

In hospitals, nursing homes and like health care facilities, basins are commonly used in caring for patients for various purposes, such as for bathing, wound irrigation, shampooing, and treating selected body parts. Generally, conventional basins are open vessels for holding liquid. Some basins may be permanently affixed to a plumbing fixture in which case the patient is brought to the basin. Other basins are portable so the basins can be carried for some distance to the patient or be used In the office, in the field, in the operating room or at an emergency site.

Portable basins are particularly desirable caring for bedridden patients. It is especially difficult to clean or treat the body of a bedridden patient. Because many bedridden patients usually have some physical mobility limitation, certain body parts may require particular attention in cleaning or treating. Realizing this, portable basins are particularly desirable to isolatably clean or treat a selected part, such as the head or limbs, of the body of a person at the bedside.

However, conventional wash basins are not suitable for comfortably receiving and supporting a selected body part within the interior of the basin while concurrently supporting an associated member of that selected body part on the edge. Resting a part of the patient's body on the top edge of a conventional basin can cause discomfort to the patient, since the top edges are not generally shaped for resting or supporting a body part thereon. Moreover, the weight of the supported body part and its associated appendages can tip the basin over. Hence, there is a need for a contoured portable basin adapted to comfortably and concurrently receive and support an isolatable selected part of the body during cleansing or treating substantially within the interior of the basin and the associated appendage of that body part on its top edge.

One problem of conventional portable basins is that the liquid medium which is present in the basin becomes contaminated, soiled and unsanitary once it has been used to clean or treat a body part during such a procedure. In order to maintain the body part away from contact with this contaminated liquid during a procedure, the portable basin must be periodically manually carried to a disposal site, the unsanitary liquid removed from the basin, the basin washed or rinsed and refilled with fresh liquid. This method for maintaining a clean medium is cumbersome and possible splashing or sloshing spillage of the contents can expose the care giver to disease.

There is also a need, therefore, for a portable basin having an outlet for removing liquid contents from the basin to facilitate uninterrupted cleansing and treating of the selected body part of a patient. This would avoid the risk of exposure to the care giver from contact with unsanitary liquids and permit a substantially continuous delivery of fresh liquid medium to the body part during the procedure being performed substantially within the basin. Additionally, if the soiled washing medium is desirably removed from the basin at a controlled rate, as by a drainage system, prolonged contact of the body part with the medium used for the treatment can be avoided.

Some past attempts to provide vessels for comfortably selectively cleaning or treating parts of the body have been made. U.S. Pat. No. 3,083,376, for example, discloses the use of a multi-piece vessel for treating the trunk of the body and the use of resilient compressible cushion members to support the neck on the edge and buttocks in the interior of the basin. However, such cushion members typically are porous and multi-piece vessels have crevices. Crevices and porous materials are both undesirable for health care basins since they are conducive to the growth of germs.

There is still a need, therefore, for a portable basin for isolatably washing, cleansing or treating a selected body part, especially the head and limbs having a substantially seamless, unitary construction which can be economically produced of a material that is substantially non-toxic and non-irritating to human skin. In particular, there is still a need for a portable basin that is lightweight yet is structurally sturdy. Ideally, such a basin should also be easily handled and be usable on a bed, a table, or the like without tipping over easily.

A contoured, unitary, self stabilizing basin of the present invention overcomes the foregoing problems and meets the desired needs.

SUMMARY OF THE INVENTION

A portable, contoured basin is described having certain stabilizing features. The basin is adapted to receive and support a selected body part of a person within an interior of the basin for isolated cleansing, treatment and the like, while the associated trunk end portion or extremity of the same selected body part is concurrently received and supported on the top edge of the basin without discomfort to the person.

Briefly described, the basin embodying the principles of this invention comprises a generally open-top pan having a contoured bottom and its interior surface and exterior surface defined by a substantially continuous sidewall having at least a section of its top edge also contoured. The disclosed basin is self-stabilizing by virtue of its unitary and buttress-like construction.

More specifically, the bottom of the disclosed basin comprises a lower base portion and an integral elevated platform portion. The elevated platform portion has a top surface which is dimensionally sized and shaded to receive and support the selected body part in direct contact thereon. The term "selected body part" as used herein can include the head of a person, a limb, such as the leg or arm, or the extremity of a limb, such as the foot or hand. The elevated platform portion is sufficiently elevated to maintain the selected body part above and away from contact with the lower base portion.

The continuous sidewall of the basin comprises an inner sidewall portion, an outer sidewall portion and a top edge formed by joining the inner sidewall portion at its terminus to the outer sidewall portion. The inner sidewall portion extends from the bottom upwardly to a terminus at a height at least above that of the top surface of the elevated platform portion. The outer sidewall extends downwardly from the top edge and outwardly relative to the bottom and terminates in a bottom edge.

The length of the outer sidewall determined from the top edge to the bottom edge is sufficient to provide a buttress for giving sideways stability to the basin.

The top edge of the sidewall has at least one seat defined by a notch in at least one portion thereof. This seat is configured for receiving and supporting an associated member of the selected body part in direct contact thereon. The term "associated member" with reference to the selected body part as used herein can include the trunk end of the selected body part, such as the neck of the head; the upper appendage of a limb, such as the upper arm and the thigh; and the extremity of a limb, such as the hand and foot.

At least a section of the inner sidewall portion adjacent the lower base portion is in spaced relationship to the elevated platform portion such that the elevated platform portion, the section of the inner sidewall portion, and the lower base portion cooperatively define a channel adapted to receive and hold a liquid. The height of each of the inner and outer sidewall portions relative to the interior depth of the basin, as determined from the top edge to the lower base portion, is such that the selected body part and its associated member respectively can be supported within the interior of the basin by the elevated platform portion and on the top edge of the basin by at least one seat substantially without discomfort to the person.

For removing liquid contents from the channel, a preferred basin of this invention includes an outlet in fluid communication with the channel. For this purpose, the outlet is preferably located on a section of the inner sidewall portion substantially adjacent the lower base portion and at least a section of the channel is sloped toward the outlet.

To further assist in removing liquid from the channel, the outlet preferably is adapted to include a drainage system. The drainage system preferably is releasably attached in liquid-tight sealable relationship about the outlet for fluid communication with the channel. A preferred drainage system comprises a hose and a clamp means releasably attached thereto for controlling the flow of the liquid from the channel.

In one preferred embodiment, at least a section of the bottom edge of the outer sidewall portion is stepped outwardly to provide a basin-stabilizing collar and the bottom edge includes a rim for auxiliary sideways stability against tipping during usage.

In another preferred embodiment, integral recessed hand gripping means having certain finger rest and thumbhold features are defined in at least one section of the outer sidewall portion as disclosed herein. This recessed hand gripping feature beneficially assists the care giver in comfortably carrying a basin of this invention, particularly when the basin contains liquid.

A portable basin embodiment of this invention has the advantage of being lightweight yet of a unitary, self-stabilizing sturdy construction. Thus it can be easily carried and employed to isolatably care for a selected part of the body of a bedridden person, even directly on the bed. A basin of this invention beneficially minimizes discomfort to the person being cared for and minimizes exposure to the care giver from contact with the liquid contents from the basin. Other features, advantages and benefit will become readily apparent from the detailed description of the invention, the accompanying drawings and the appended claims.

DETAILED DESCRIPTION OF THE PREFERRED EMBODIMENTS

Figure 1:
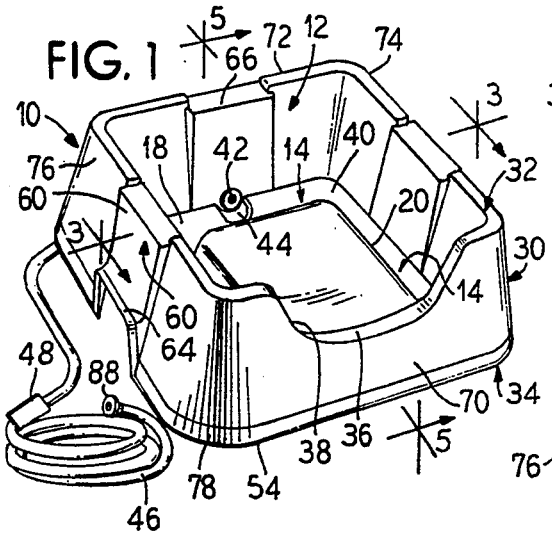
FIG. 1 is a perspective view of one preferred embodiment of a basin in accordance with the present invention adapted for cleansing the hair and treating facial and scalp areas of the head.

While this invention is conducive to providing a number of embodiments, the drawings show two specific preferred embodiments which will be described in detail. It is understood however, that the present disclosure is intended to exemplify principles of the invention and is not intended to limit the invention to the embodiments illustrated.

One preferred substantially rectangular basin embodiment adapted for shampooing the hair and for cleansing and treating facial and scalp areas of the head in accordance with the present invention is illustrated in FIGS. 1–6 and is designated generally by the reference numeral 10.

Figure 2:
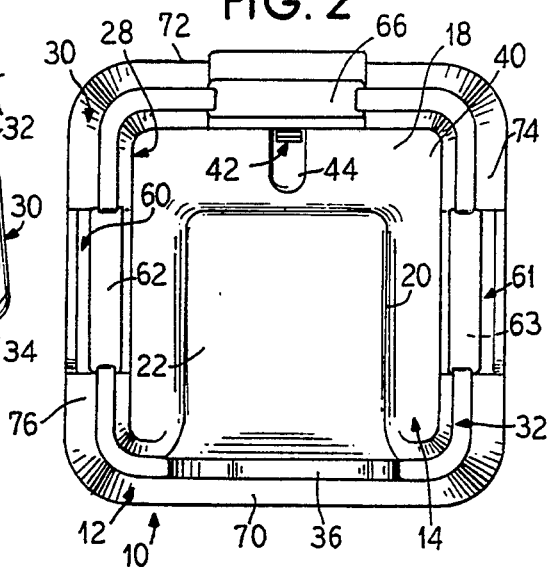
FIG. 2 is a top plan view of FIG. 1 showing the contiguous relationship of the seat for the neck to the elevated platform portion, the top edge, channel, sump and outlet for the channel to the continuous side wall of the basin.

Turning to FIGS. 1 and 2, the basin 10 is a generally open-top pan having a contoured bottom 14 and having its interior and exterior surfaces defined by a substantially continuous sidewall 12 which describes the four side panels 70, 72, 74 and 76.

As best seen in FIGS. 1–3 and 5, the bottom 14 of the basin 10 comprises a lower base portion 18 and an integrally substantially elevated platform portion 20 for supporting the head within the interior of the basin 10.

The continuous sidewall 12 comprises a first inner sidewall portion 28, a second outer sidewall portion 30 and a top edge 32, which is formed where the inner sidewall portion 28 at its terminus joins the outer sidewall portion 30. As seen in FIGS. 1 and 2 the sidewall 12 describes a front end panel 70, an opposing back end panel 72 and a pair of opposing longitudinal side panels 74, 76. Each of the panels 70, 72, 74 and 76 are in continuous relationship with one another, with the bottom 14 and with the sidewall 12. FIG. 2 shows the relationship between the continuous sidewall 12 to the front end panel 70 where the seat 36 is defined, to the opposing back end panel 72, to the pair of side panels 74, 76 and to the bottom 14.

As illustrated, the sections of the inner sidewall portion of each of panels 70, 72, 74, and 76 adjacent the lower base portion 18 are in such spaced relationship to the elevated platform portion 20 that together they cooperatively define a channel 40 adapted to receive and hold a liquid when liquid is introduced therein. A substantially central section of the top edge 32 of the sidewall 12 defining the front end panel 70 is notched to define a seat 36 for supporting the neck directly in contact thereon.

In this embodiment, the elevated platform portion 20 is generally rectangular and cooperatively extends from a section of the front end panel 70 such that the top surface 22 of elevated platform portion 20 is contiguous with the inner sidewall portion 28 adjacent the seat 36. Except for this contiguous section of the inner sidewall portion 28 of the front end panel 70 with the elevated platform portion's top surface 22, the inner sidewall portion 28 of the each of the panels 70, 72, 74, and 76 otherwise substantially extends vertically from the bottom upwardly to a terminus which is at a height at least above that of the top surface 22 of the elevated platform portion 20.

The elevated platform portion preferably extends contiguously from the front end panel 70 of the basin toward the back end panel 72 sufficiently to comfortably support the head while the neck is concurrently supported by the seat 36. The elevated platform portion is also preferably dimensionally sized and configured to support substantially the entire head of an average sized person directly in contact thereon. The elevation of the elevated platform portion 20 is preferably sufficient to keep the head raised at a distance above and away from contact with the lower base portion 18 and from the contents of liquid in the channel, when liquid is present.

The shape and the sizing of the top surface 22 of the elevated platform portion 20 and the seat 36 preferably are contoured sufficiently to maximize patient comfort during usage and to minimize stress and/or strain on the patient's head, neck and shoulders.

Figure 3:
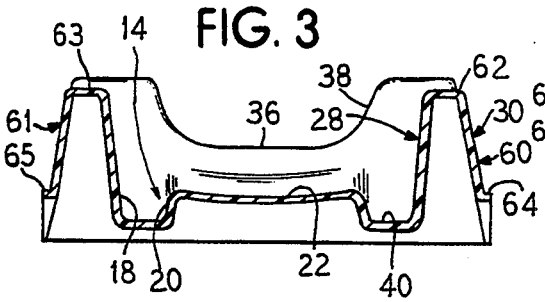
FIG. 3 is a vertical transverse cross sectional view taken along line 3—3 of FIG. 1 showing the relationship of the bottom to the side wall.

To assist in this regard, the top surface 22 of the elevated platform portion 20 is preferably smooth and slightly concave as seen in FIG. 3 so as to comfortably cradle the back skull area of the head in direct contact thereon during a shampooing or scalp treatment procedure. Additionally, the overall shape and size of the seat 36 is smoothly contoured and notched to a depth sufficient to cradle and support the neck. As best illustrated in FIGS. 1–3, a suitable neck supporting means can be defined as by a substantially semi-elliptical notch 38 to provide a saddle-like support at the juncture of the patient's shoulder-neck area.

For convenience, the following features of the sidewall which are discussed are applicable to any basin embodying the principles of this invention regardless of external configurational shape. Thus in the following discussion, reference to any specific defined panel of the rectangular embodiment is omitted because the benefit of the feature applies equally to each.

Figure 4:
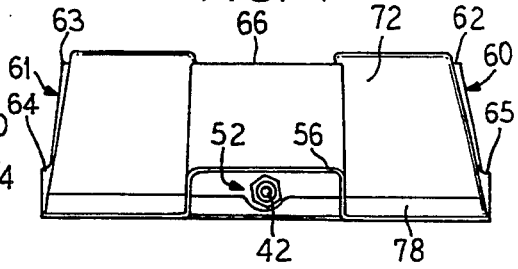
FIG. 4 is a rear elevational view of FIG. 1 showing the passageway and the outlet.
Figure 5:
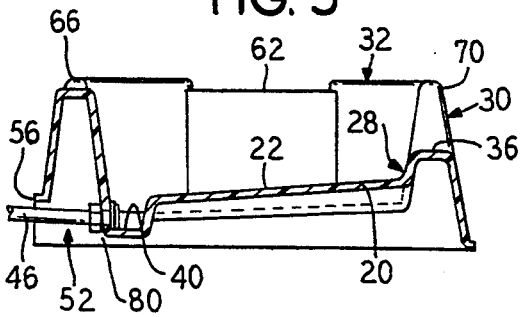
FIG. 5 is a vertical longitudinal cross sectional view taken along line 5—5 of FIG. 1 showing the continuous relationship of the elevated platform portion to the outlet, the bottom and the passageway.

Thus, the cross sectional views seen in FIGS. 3 and 5 generally illustrate the relationship of the bottom 14 to the sidewall 12 and the self-stabilizing feature provided by the buttress like construction of the basin 10. As illustrated in FIGS. 1 and 3–5, the continuous outer sidewall portion 30 preferably extends downwardly from the top edge 32 of basin 10 and angles outwardly relative to the bottom 14 to terminate in a bottom edge 34. The length of the outer sidewall portion 30 is not limited other than that it be sufficient to provide sideways stability to the basin 10. Preferably, the bottom edge 34 includes a rim 54 to provide additional sideways stability to the basin.

The basin 10 is substantially stabilized by the angled outer sidewall portion 30 relative to the top edge 32. For additional stability, a continuous section of the bottom edge 34 of the outer sidewall portion 30 is preferably stepped outwardly to provide a basin-stabilizing collar 78, best seen in FIGS. 1 and 4. The collar 78 also enlarges the surface area described by the bottom edge 34 of the basin 10 to provide greater sideways support for the basin during usage. For further stability, as illustrated in FIG. 1, the rim 54 also preferably is flared outwardly where the outer sidewall portion 30 describes the cornering of each panel to provide a further stabilizing means.

Returning to the rectangular basin 10 illustrated in FIGS. 1–6, The elevated platform portion is preferably configured to be a size and shape capable of comfortably receiving and supporting the entire head of a person within the interior of the basin and the defined seat is configured to be a size and shape capable of comfortably and concurrently receiving and supporting the neck of the person during usage of the basin.

The cross-sectional view seen in of FIG. 5 illustrates the contiguous relationship of the top surface 22 of the elevated platform portion 20 to the channel 40. The top surface of the elevated platform portion 22 preferably slopes downwardly from the seat 36 toward the channel 40 to direct liquid flowing from the elevated platform portion 20 during usage to the channel but the slope is sufficiently shallow to avoid discomfort to the user. Thus, when liquid is used to shampoo the hair or to treat the scalp, for example, it is directed toward the channel 40 and held therein until removed.

To assist in removal of liquid contents from the channel 40 after a procedure, the channel 40 preferably includes an outlet 42 in fluid communication with the channel 40. The outlet 42, as illustrated in FIGS. 1, 2, 4 and 5 is preferably centrally located on a section of the inner sidewall portion 28 of the back end panel 72 that is substantially adjacent to the lower base portion 18 of the bottom 14. To further assist in removing liquid, at least a section of the channel 40 is sloped toward the outlet 42. The positioning of the outlet in a central location relative to the elevated platform portion 20, therefore, also advantageously allows the outlet to directly receive liquid flowing from the elevated platform portion for faster removal.

Figure 6:
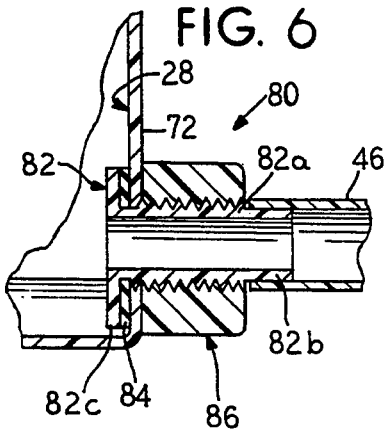
FIG. 6 is an enlarged fragmentary vertical longitudinal cross sectional view of FIG. 5 taken in the region of the drainage system and showing it in releasably sealed liquid-tight association with the outlet.

The outlet 42 is preferably dimensioned such that a drainage system can be releasably adapted in liquid-tight sealable relationship. Preferably the drainage system includes a hose 46 and a clamp means 48 for controlling the removal of liquid from the channel 40 and away from the basin. By way of illustration and not by limitation, a useful preferred drainage system is shown in FIGS. 5 and 6, and is designated generally by the numeral 80. It is to be understood that any drainage system suitable for a basin embodying the principles of this invention comes within the scope of this invention.

FIG. 6 is an enlarged view of one preferred embodiment of the drainage system 80. As illustrated, the drainage system assembly includes an adapter 82, a washer ring 84 and a hose 46. For placing the adapter in liquid-tight sealed relationship about the outlet, a nut and bolt-type assembly is preferred as illustrated.

The adapter 82, as illustrated, is a hollow bolt, the shaft of which has a threaded portion 82*a* and an unthreaded nipple end 82*b* and a head portion 82*c*. The external diameter of the adapter is sufficiently smaller than the diameter of the outlet 42 to allow the head portion 82*c* of the adapter 82 to be seated in releasable association with the inner sidewall portion 28 of the outlet 42 with the shaft extending outwardly from the basin.

To assist in placing the adapter 82 in liquid-tight sealed relationship with the outlet 42, the washer ring 84 is preferably releasably associated about the interior surface of the outlet 42 between the inner sidewall portion and the head portion 82*c*. The nut 86 is threadably associated with the threaded portion 82*a* of the adapter 82 about the exterior surface of the outlet 42. The hose 46 can then be releasably attached and secured about the nipple end 82*b*.

Preferably, as seen in FIG. 1, the hose 46 is provided with a clamp means 48 releasably attached thereto for controlling the removal of liquid from the channel 40. Preferably, the terminus of the hose 46 opposite the outlet 42 is further provided with an end plug 88 releasably associated therein. Thus some of the liquid can be removed from the channel 40 during usage by operating the clamp means to drain liquid into the hose 46 and hold it therein by means of the end plug 88, if necessary, until the contents of the basin can be delivered to a disposal site. To assist in this regard, the hose 46 desirably has a length of preferably about 6 feet to provide an auxiliary reservoir for the channel during a procedure using a liquid.

For example during a shampoo and rinse procedure, some of the liquid medium used for the shampoo step can be drained into the hose, if necessary, and held therein while the next liquid rinse step is performed with substantially no interruption of the cleansing procedure.

FIG. 4 shows an elevational view of the back end panel 72. As shown, a section of the bottom edge 34 of the outer sidewall portion 30 of back end panel 72 opposite the outlet 42 is preferably notched upwardly sufficiently to define a passageway 52. The rim 54 preferably is flared in the notched portion to define a flange 56. The passageway 52 allows access to the outlet 42 for attaching the drainage system and for extending the hose 46 outwardly from the outlet 42 and away from the basin 10. The flange 56 helps protect the hand during the attachment of the drainage system to the outlet and helps guide the hose outwardly.

To further assist in removing a liquid from the channel 40, a section of the lower base portion of the channel 40 adjacent the outlet 42 is recessed to define a sump 44. The outlet 42 preferably is in fluid communication with the sump 44 as illustrated in FIGS. 1, 2, 4 and 5. FIG. 1 also illustrates basin 10 associated with a drainage system and ready for usage.

A basin of this invention preferably has an integral recessed hand gripping means to assist in easy carrying, especially when liquid is present. In the preferred basin 10 embodiment, a pair of opposed recessed hand gripping means 60, 61 are defined. As shown in FIGS. 1–4, a section of the bottom edge 34 of the outer sidewall portion 30 of each of the opposing side panels 74, 76 is respectively notched upwardly sufficiently to define a pair of recessed integral hand gripping means 60 and 61. Each of the gripping means 60, 61 is defined from the top edge 32 to the bottom edge 34 of the outer sidewall portion 30.

Preferably the rim 54 of the bottom edge 34 is outwardly and upwardly flared in each of the notched section of the hand gripping means 60, 61 to define a respective flange 64, 65. The flared shape of each of flange 64, 65 provides a relatively comfortable finger rest. To further assist in carrying the basin, the top edge 32 of each defined hand gripping means 60, 61 respectively is stepped downwardly sufficiently to define a thumbhold 62, 63.

By virtue of the configuration of the interior and exterior surfaces, a basin of the present invention may also be nestable with another basin having a like contoured silhouette. For nesting basin 10, the central section of the top edge 32 of the back end panel 72 is stepped downwardly to define a substantially flat ledge 66. The flat ledge 66 is preferably substantially parallel to the top edge 32 to provide a stacking stop means. Thus the top edge of one basin cooperates with the underside of a complimentary top edge of another like basin to maintain each basin in spaced nested relationship to one another.

To further assist in nesting like basins of this invention, the section of each of the inner sidewall portion 28 and the outer sidewall portion 30 extending downwardly from each defined hand gripping means 60 and 61 relative to the bottom 14 is preferably laterally stepped inwardly and outwardly respectively. As a result, one basin can be nested with a second basin having a like silhouette and maintained in a substantially parallel relationship with an airspace therebetween for relatively easy denesting.

Another preferred alternative substantially rectangular basin embodiment which is also adapted for isolatably cleansing, irrigating and treating a limb part of a body in accordance with this invention is illustrated in FIGS. 7–12. This basin embodiment is designated generally by the reference numeral 110.

Basin 110 is versatile enough to be used for the irrigation and debridement of various body parts, such as the eye, ear, head, upper arm, forearm, wrist, hand, fingers, thigh, calf, ankle, foot and toes. Thus basin 110 provides an alternative to basin 10 for treating and cleaning portions of the head, scalp and face, as well as a selected limb part and its associated extremities.

As seen in FIGS. 7–11, aside from differences discussed below in the general dimensional shape and size of basin 110, and in the positioning of certain features, the same beneficial features of basin 10 previously discussed otherwise apply substantially equally to basin 110 and are repeated here by incorporation.

More specifically, the similarity of the beneficial features can be readily seen in FIGS. 7–11, with respect to the featured relationships of: (a) the continuous sidewall 112 to the bottom 114; (b) the inner sidewall portion 128 to the top edge 132 and to the outer sidewall portion 130; (c) the cooperative definition of the channel 140 by the spaced relationship of the lower base portion 118 to a section of the inner sidewall portion 128 and the elevated platform portion 120; (d) the sideways stabilization of basin 110 by the buttress-like construction provided by the outer sidewall portion 130; (e) the definition the opposing end panels 170, 172 and opposing side panels, 174, 176 by the continuous sidewall 112; (f) the definition of the paired recessed hand gripping means 160, 161; and (g) the adaptability of the outlet 142 to a drainage system 180 for removal of a liquid from the defined channel 140 when water, other liquid or blood is present therein.

Figure 7:
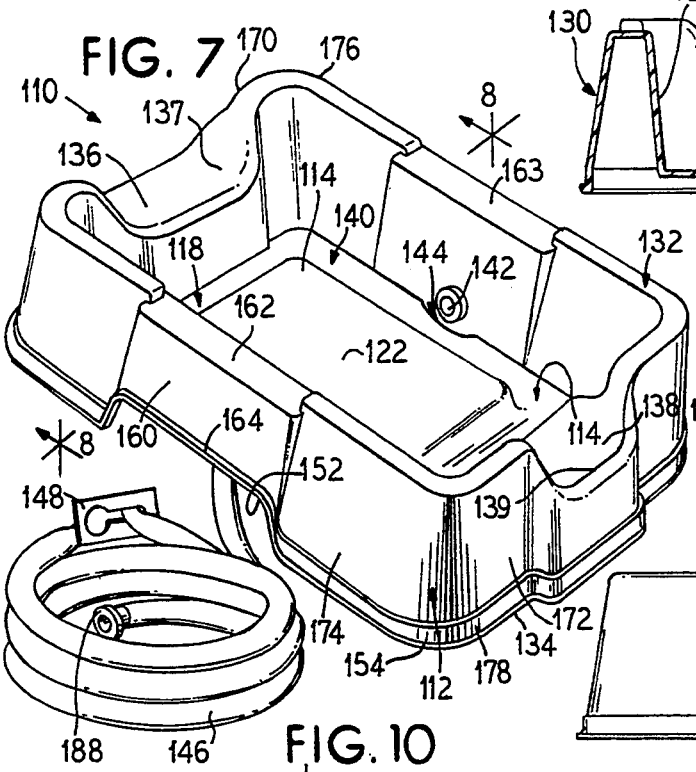
FIG. 7 is a perspective view of an alternative preferred embodiment of a contoured basin in accordance with the present invention adapted with two opposing seats of differing size and shape for also cleansing and treating a limb of the body.
Figure 8:
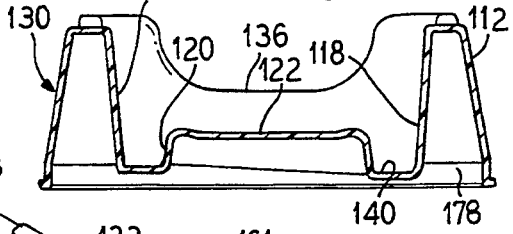
FIG. 8 is a vertical transverse cross sectional view taken along the line 8—8 of FIG. 7 showing the relationship of the bottom to the sidewall and to the larger sized of the two seats.

Turning to FIGS. 7 and 8, basin embodiment 110 is illustrated having a pair of opposing end panels 170, 172, and a pair of opposing longitudinal side panels 174, 176. The side panels 174, 176 preferably are longer than the width of the opposing end panels 170, 172 so that a limb, such as a leg or forearm can be received substantially horizontally within the interior of basin 110 between the opposing end panels 170, 172.

Figure 10:
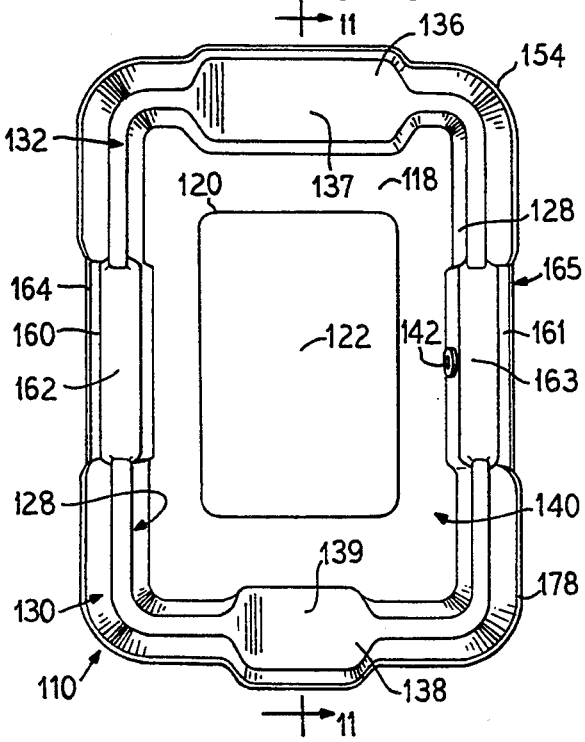
FIG. 10 is a top plan view of FIG. 7 showing the relationship of the two opposing seats to the elevated platform portion, the top edge, the channel, the outlet, and the sidewall of the basin.

The top plan view seen in FIG. 10 illustrates a preferred dimensional relationship of the end panels 170, 172, and the side panels 174, 176 with one another, to the bottom 114 and to the side wall 112. The length of the side panels of basin 110 is not limited so long as they are sufficient to receive a limb, such as a leg or a forearm, of a substantially average-sized person within the interior of the basin 110 while its associated trunk end portion, extremity or both is concurrently supported by one or both of the two opposing seats means 136, 138.

Preferably each of the two opposing seat 136, 138 is defined substantially in the center section of the top edge of each one of respective opposing side panels 170, 172. Preferably, the configuration of one of the seat differs in size and shape relative to that of the second seat to better adapt the basin for receiving and supporting various sizes of associated members of the selected limb part. This is illustrated in FIGS. 7 and 10, for example, where the seat 136 defined on the top edge of end panel 170 is substantially larger relative to the seat 138 defined on the top edge of end panel 172.

Thus, one of the seats is preferably shaped and sized to support a relatively large or trunk end of a limb, such as the upper arm and the thigh, the ankle, and the opposing seat is preferably shaped and sized to support a relatively small limb or extremity end of a limb such as the wrist, the hand or the foot. The smaller sized seat also preferably is shaped and sized to support the neck of a person.

As seen in FIGS. 7, 8, 10 and 11, the bottom 114 of basin 110 also comprises a lower base portion 118 and an integral substantially rectangular elevated platform portion 120. For this preferred basin embodiment, the elevated platform portion 120 preferably is located substantially in the center of the bottom 114 and is substantially rectangular in shape as illustrated but is not so limited.

The overall dimensional shape and size of the elevated platform portion 120 is not limited so long as it can receive and support the selected limb part within the interior of basin 110. Similarly, the length of the elevated platform portion 120 relative to the inner sidewall portion 128 of each of the end panels 170, 172 is not limited so long as it beneficially allows the care giver the option of treating either the head or a limb of a person within the interior of basin 110.

Hence, as discussed earlier with respect to basin 10, the top surface 122 of the elevated platform portion 120 also preferably is dimensionally shaped, sized and contoured to cradle and support either the head, a limb or an extremity in direct contact thereon. As in basin 10, the selected body part is supported by the elevated platform portion 120 above and away from contact with the lower base portion 118 to avoid having it directly contact the contents of the channel 140.

Figure 9:
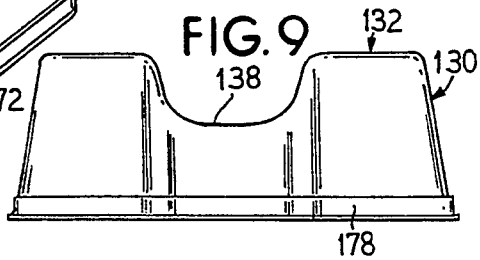
FIG. 9 is an end elevational view of the basin embodiment shown in FIG. 7 showing the smaller sized of the two seats.

As best seen in FIGS. 7, 8, 9 and 10, each of the seat 136 and 138 respectively is defined by a notch in a central section of the top edge 132 of each of end panel 170 and 172 of basin 110. By way of illustration and not by limitation, seat 136 has a substantially semi-elliptical silhouette as seen in FIG. 8 so that it is larger relative to seat 138, which has a substantially semicircular silhouette as seen in FIG. 9.

Preferably each seat 136, 138 respectively has a substantially horizontal base 137, 139 which is cooperatively formed by laterally extending each of the inner sidewall portion 128 and the outer sidewall portion 130 of each defined seat 136, 138 from the top edge relative to the bottom. This lateral extension respectively provides a seat base 137, 139 having a width greater than the width of the top edge 132, as seen in FIGS. 7 and 10.

As best seen in FIGS. 7, 8, 10 and 11, the channel 140 is cooperatively defined by the spacing of the section of the inner sidewall portion 128 adjacent the lower base portion 118 of each of the panels 170, 172, 174 and 176, the elevated platform portion 120 and the bottom 114.

Thus in basin 110, the defined channel 140 can receive and hold a liquid flowing from substantially any section of the top surface 122 of the elevated platform portion 120 during an irrigation or a cleansing procedure using water or another liquid medium. Additionally, the channel 140 can receive and hold a body fluid, such as blood from a wound site or the like, which might flow from the body part during a procedure or while awaiting a procedure.

Figure 11:
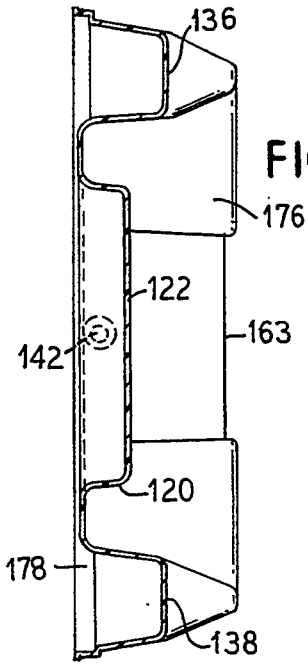
FIG. 11 is a vertical longitudinal cross sectional view taken along the line 11—11 of the basin embodiment shown in FIG. 10 showing the relationship of the outlet to the bottom of the basin.

For removing liquid contents from the channel 140, basin 110 also preferably includes an outlet 142 in fluid communication with the channel 140. For this embodiment, the outlet 142 can be preferably located on a section of the inner sidewall portion 128 transverse to each of the seat and substantially adjacent the lower base portion 118. By way of illustration and not by limitation, the outlet 142 is preferably centrally positioned on a side panel, such as side panel 176, as illustrated in FIGS. 7, 10 and 11. This side panel positioning helps avoid interference with the usage of the seat 136, 138 during removal of liquid from the channel 140.

The depth of the channel 140 of basin 110 preferably is defined to guide a liquid received therein to the outlet 142 for removal therefrom. Preferably, the section of the channel 140 opposite the outlet 142 is defined to be substantially more shallow than the remaining sections of the defined channel. As seen in FIG. 8, this shallowed definition slopes the pitch of the channel 140 to assist in directing received liquid toward the outlet 142. As a further means for assisting in removal of a liquid from the channel 140, at least a section of the lower base portion 118 adjacent the outlet 142 is also recessed to define a sump 144, as seen in FIG. 7. The outlet 142 preferably is in fluid communication with the sump 144.

Figure 12:
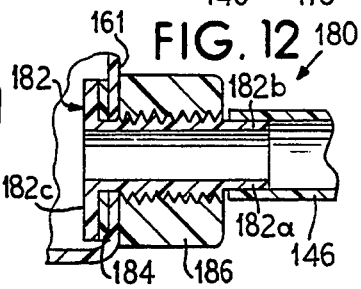
FIG. 12 is an enlarged fragmentary vertical longitudinal cross sectional view of the basin embodiment shown in FIG. 11 taken in the region of the drainage system showing it in releasably sealed liquid-tight relationship with the outlet.

To further assist in removing a liquid from the channel 140, the outlet 142 preferably is also adapted to include a drainage system. By way of illustration and not by limitation, FIG. 12 is an enlarged view of a drainage system generally designated by the numeral 180 having substantially similar nut and bolt-type assembly features as the drainage system 80 described earlier for basin 10. As illustrated, therefore, the drainage system 180 similarly comprises an assembly which includes an adapter 182, a washer ring 184 and a hose 146. As in basin 10, the adapter 182 can be a hollow bolt, the shaft of which has a threaded portion 182*a* and an unthreaded nipple end 182*b* and a head portion 182*c* and is placed in releasable water-tight sealed association with outlet 142 as earlier described and repeated herein by reference.

Preferably, as seen in FIG. 7, the hose 146 is also provided with a clamp means 148 and the terminus of the hose 146 opposite the outlet 142 is further provided with an end plug 188 releasably associated therein. Thus, FIG. 7 illustrates basin 110 in position ready for usage.

Basin embodiment 110, like basin 10, also has a pair of recessed hand gripping means 160, 161, each defined by a section of each of the bottom edge 134 of the outer sidewall portion 130 being upwardly notched, as best seen in FIG. 7. The features of the defined hand gripping means with regard to the pair of defined flanged finger rests, 164, 165 and pair of defined thumbholds, 162, 163 are substantially similar to those of the hand gripping means previously described for basin 10 and that description is repeated herein by reference.

Basin 110, as illustrated in FIGS. 7 and 10, differs from basin 10 in that the recessed hand gripping are defined substantially at a central section of each of side panels 174, 176 so that one of the defined hand gripping means, 160, is opposite the outlet 142. By this positioning, the notched section of the defined hand gripping means 160 provides access to the outlet 142 for attaching the drainage system to the outlet. Additionally, each one of the defined recessed hand gripping means 160, 161 further can provide a passageway for extending the hose 146 outwardly from the outlet 142 and away from the basin 110. For example, the hose 146 can be extended directly outwardly through the passageway defined by hand gripping means 161 or it can be routed about the contour of the exterior surface of the bottom 114 to extend outwardly through the passageway 152 defined by hand gripping means 160, as seen in FIG. 7.

Additionally, in basin 110, each of the defined thumbholds, 162, 163 also serve as the stop means for nesting basin 110 with a second basin having a like contoured silhouette as discussed earlier.

As seen in FIGS. 7–11, a continuous section of the bottom edge 134 of the outer sidewall portion surface of basin 110, like that of basin 10, preferably also includes a stabilizing collar 178, and a rim 154. The rim 154 is preferably flared outwardly, especially where the outer sidewall portion 130 defines the cornering of each panel to provide further sideways stability to the basin.

The height of the inner sidewall portion 128 relative to the interior depth of basin 110 and the height of the outer side wall 130 relative to the bottom 114 is not limited. The only criteria is that the selected limb part of a person be supportable on the top surface 122 of the elevated platform portion 120 within the interior of the basin while the associated member of the selected limb part is concurrently supported by the seat 136 and 138 substantially without discomfort to the person.

Thus where the selected body part constitutes the head of a person, the neck is preferably comfortably supported on one of the two seats while the head is comfortably supported by the top surface 122 of the elevated platform portion 120. Accordingly, where the selected body part constitutes a limb, the part of the limb to be subjected to a procedure within the interior of the basin should be comfortably supportable by the elevated platform portion therein while the associated trunk end of the limb or its appendage is concurrently comfortably supported on one or both of the seats substantially horizontally relative thereto.

For example, the upper arm can be supported by one of the defined seats while the forearm is supported by the elevated platform portion, with the wrist and hand supported either by the elevated platform portion or the opposing seats, depending on the length of the person's arm. Alternatively, the thigh of a person can be supported by the larger of the defined seats while the calf of the leg is supported by the elevated platform portion and the ankle is supported by the smaller of the opposed defined seat.

A contoured basin of the type in either FIG. 1 or 7, therefore, can be of any overall dimension desired so long as the principles of this invention can be practiced. It has been found, however, that a useful shampoo/rinse basin embodying the principles of this invention, as illustrated in FIG. 1, preferably has an overall exterior dimension of about 6⅜ inches (about 16 centimeters) in height determined from the top edge downward to the bottom edge of the sidewall transverse to the seat, about 18⅛ inches (about 46 centimeters) in length determined transverse to the seat, and about 17½ inches (about 45 centimeters) in width.

A useful top surface of the elevated platform portion has been found to be preferably about 6⅜ inches (about 16 centimeters) in width and extending about 9½ inches (about 24 centimeters) in length from the inner sidewall portion. The seat is preferably substantially semi-elliptical in shape, about 9½ inches (about 24 centimeters) in width at the top edge and notched to a depth of about 3⅛ inches (about 8 centimeters) at its base. Preferably the top surface of the elevated platform portion is sloped downwardly to about 4 degrees from horizontal from the seat toward the channel.

A useful extremity limb basin embodying the principles of this invention, as illustrated in FIG. 7, has been found to preferably have an overall exterior dimension of about 5 inches (about 13 centimeters) in height determined from the top edge downward to the bottom edge of the sidewall transverse to the seat, about 19½ inches (about 50 centimeters) in length determined transverse to the seat and about 13½ inches (about 34 centimeters) in width. A useful sized elevated platform portion is preferably about 6 inches (about 15 centimeters) in width and about 8½ inches (about 22 centimeters) in length.

One seat is preferably substantially semi-elliptical in shape, about 6½ inches (about 17 centimeters) in width at the top edge and the other seat is preferably substantially semi-circular in shape, about 5 inches (about 13 centimeters) in width at the top edge. Each seat preferably is notched to a depth of about 2½ inches (about 6½ centimeters) at its base and has a lateral width at the center of its base of about 2½ inches (about 6½ centimeters).

One benefit of a basin of this invention is that it is structured to be sturdy and self-stabilized when in use. As described, the outer sidewall portion is sloped downwardly and outwardly away from the bottom edge of the basin. This forms a buttress like construction between the inner sidewall portion panel and the outer sidewall portion panel. The buttressing of the outer sidewall portion describes a larger circumference at the bottom edge of the sidewall than that at the top edge to thereby prevent the basin from tipping over.

The configuration of the recessed handles facilitates lifting of the basin comfortably. Additionally, the lateral extension of the sidewall of the defined hand gripping means serves to reinforce the recessed handles and enhances the strength and stability of the basin so that the basin can be carried, when filled with liquid, and without being susceptible to breakage under normal conditions.

A suitable diameter for the outlet of a basin of this invention is about 1 inch (about 2.5 centimeters) for connection to a drainage system including a relatively conventional hose. A particularly useful and preferred hose is made of a flexible plastic tubing, such as the well-known tubing sold under the trademark TYGON. A preferred practical length for the hose of this invention is about six feet but is not so limited. Preferably, all of the elements of the drainage system are composed of a plastic material. Desirably, the liquid volume capacity of the channel of a basin of this invention can contain up to about 4 liters (about 4000 cubic centimeters).

Preferably, the entire surface of a basin of this invention is preferably smooth with rounded edges. The advantages of a rounded-edge basin avoids causing discomfort to the user since these basins are primarily intended for use by persons confined to a bed or persons with limited movement capabilities.

Desirably, a basin of this invention is constructed of a suitable material which is non-toxic to humans, shape retentive, light weight, durable, sanitizable and sterilizable. Preferably the basin should withstand sterilization with ethylene oxide gas or cobalt 60 gamma radiation, for example. Additionally, rounded edges beneficially minimize tearing of an overwrap when a basin has been sterilized. Because a common application using this basin is to perform procedures that place the patient's skin in direct contact with the surfaces of the basin and possibly with the open wound of the patient, a non-irritating and non-toxic, sterile environment is desired.

Preferably, a basin of this invention and all its preferred features is integrally formed of a plastic material. A basin embodying the principles of this invention can be constructed by generally known manufacturing operations, such as vacuum forming, injection molding, blow molding, drawing and the like. Vacuum forming is particularly preferred.

The plastic material is preferably a thermoplastic resin and can range from a wide variety of materials, including extrudable plastic materials, such as but not limited to polystyrenes, including those of the high impact and impact type, polysulphones, polyethylenes, polypropylenes, polyvinylchlorides, polyethylene terephthalates (PET), acrylic plastics and the like. High impact polystyrene is particularly preferred for forming a basin exhibiting a uniform profile and a substantially uniform relatively thin wall thickness. These thermoplastic materials can include fillers, plasticizers, colorants, or other ordinary additives, so long as the sturdiness and self-stabilizing features of the basin are unchanged.

It should be understood that various modifications, changes, and variations may be made in details of the invention enclosed herein without departing from the spirit and scope of the invention.

What is claimed is:

1. A unitary contoured basin adapted to receive and support a selected body part of a person for isolated cleansing, treatment and the like comprising:

a generally open-top pan having a bottom and its interior surface and exterior surface defined by a substantially continuous sidewall;

the bottom comprising a lower base portion and an integral elevated platform portion, the elevated platform portion having a top surface which is dimensionally sized to receive and support the selected body part in direct contact thereon and above and away from contact with the lower base portion;

the sidewall comprising an inner sidewall portion, an outer sidewall portion and a top edge formed by joining the inner sidewall portion at its terminus to the outer sidewall portion, the inner sidewall portion extending from the bottom upwardly to a terminus at a height at least above that of the top surface of the elevated platform portion, the outer sidewall portion extending downwardly from the top edge and outwardly relative to the bottom, the outer sidewall portion terminating in a bottom edge and having a length sufficient to provide sideways stability to the basin;

the top edge having at least one seat defined by a notch in at least one portion thereof configured for receiving and supporting an associated member of the selected body part;

at least a section of the top edge is stepped downwardly to define at least one ledge, the inner sidewall portion extending downwardly from the ledge to the bottom is stepped inwardly and the opposing outer sidewall portion extending downwardly from the ledge to the bottom edge is stepped outwardly to define at least one stop means such that the basin can be nested within another like basin;

at least a section of the inner sidewall portion adjacent the lower base portion being in spaced relationship to the elevated platform portion such that the elevated platform portion, the section of the inner sidewall portion, and the lower base portion cooperatively define a channel adapted to receive and hold a liquid when liquid is introduced therein; and the height of each of the inner and outer sidewall portions relative to the interior depth of the basin determined from the top edge to the lower base portion being such that the selected body part can be supported within the interior of the basin by the elevated platform portion while its associated member is supported by the at least one seat without discomfort to the person.

2. The basin of claim 1, including an outlet in fluid communication with the channel, the outlet being adapted for removing a liquid from the channel.

3. The basin of claim 2, wherein the outlet is located on a section of the inner sidewall portion substantially adjacent the lower base portion and at least a section of the channel is sloped toward the outlet.

4. The basin of claim 3, wherein at least a section of the lower base portion adjacent the outlet is recessed sufficiently to define a sump and the outlet is in fluid communication with the sump.

5. The basin of claim 2, including a drainage system releasably attached about the outlet and in fluid communication with the channel.

6. The basin of claim 5, wherein the drainage system comprises a hose and a clamp means releasably attached thereto for controlling the flow of the liquid therethrough.

7. The basin of claim 6, wherein the hose at its terminus opposite the outlet further includes a closure in releasably sealed relationship therewith.

8. The basin of claim 1, including an outlet in fluid communication with the channel located on a section of the inner sidewall portion substantially adjacent the lower base portion, the outlet being releasably adapted for flow of liquid therethrough to a drainage system in fluid communication with the channel, and a section of the bottom edge of the outer sidewall portion opposite the outlet being notched upwardly sufficiently to define a passageway for extending the drainage system outwardly from the basin.

9. The basin of claim 1, wherein the bottom edge of the outer sidewall portion includes a rim to provide further sideways stability to the basin.

10. The basin of claim 1, wherein at least a section of the bottom edge of the outer sidewall portion is stepped outwardly to provide a basin-stabilizing collar and the bottom edge includes a rim.

11. The basin of claim 1, wherein at least one section of the bottom edge of the outer sidewall portion is notched upwardly sufficiently to define an integral recessed hand gripping means determined from the notch upward to the top edge of the sidewall.

12. The basin of claim 11, wherein the top edge of the sidewall associated with the defined hand gripping means is stepped downwardly sufficiently to define a thumbhold, the bottom edge includes a rim and the rim is outwardly and upwardly flared in the notched section of the bottom edge to define a flange to thereby provide a finger rest.

13. The basin of claim 1, wherein the seat is configured to receive and support the neck of a person such that the head can be received and supported by the elevated platform portion.

14. The basin of claim 1, wherein the seat has a portion bounded by the inner sidewall portion and outer sidewall portion associated with the defined seat to define a lateral width greater than that of the top edge.

15. The basin of claim 1, having at least two opposing seats so defined.

16. The basin of claim 1, wherein at least two opposing seats are defined, each one of the seats being of differing dimensional size and shape relative to one another.

17. The basin of claim 1, wherein the elevated platform portion is located substantially in the center of the bottom.

18. The basin of claim 1, wherein at least one section of the top surface of the elevated platform portion is contiguous with the inner sidewall portion of the at least one defined seat.

19. The basin of claim 1, wherein the sidewall and bottom are configured such that the basin can be nested with a similarly configured like basin.

20. A stack of at least two basins of claim 1.

21. The basin of claim 1 composed of a plastic material that is sanitizable and sterilizable.

22. A substantially rectangular unitary contoured basin adapted for receiving and supporting the head and neck of a person for cleansing the head hair, treating a portion of the head and scalp, and the like comprising:

a generally open-top pan having a bottom, its interior surface and exterior surface defined by a substantially continuous sidewall, the sidewall describing a pair of side panels, a front end panel and an opposing back end panel, each of said panels being in continuous relationship with one another, the bottom, and the sidewall, said front end panel having opposite end sections and an intermediate section, the bottom comprising a lower base portion and an integral elevated platform portion having a top surface which is dimensionally sized and shaped to receive and support substantially the entire head of a person in direct contact thereon above and away from contact with the lower base portion, the elevated platform portion contiguously extending from said intermediate section of the front end panel;

the sidewall comprising an inner sidewall portion, an outer sidewall portion and a top edge formed by joining the inner sidewall portion at its terminus to the outer sidewall portion, the inner sidewall portion of each one of the side panels, the back end panel and the opposite end sections of the front end panel extending from the lower base portion upwardly to a terminus at a height at least above that of the top surface of the elevated platform portion, the outer sidewall portion extending downwardly from the top edge and outwardly relative to the bottom, the outer sidewall portion terminating in a bottom edge and having a length sufficient to provide sideways stability to the basin;

the top edge of the front end panel having a seat defined by a notch on a section thereof configured for receiving and supporting the neck of the person's head in direct contact thereon, the inner sidewall portion adjacent the top edge of the defined seat extending inwardly to cooperatively define the contiguous top surface of the elevated platform portion extending therefrom;

the sections of the inner sidewall portion of the side panels, back end panel, and opposite end sections of the front end panel adjacent the lower base portion being in spaced relationship to the elevated platform portion such that the elevated platform portion, the section of the inner sidewall portion, and the lower base portion cooperatively define a channel adapted to receive and hold a liquid flowing from the elevated platform portion, the top surface of the elevated platform portion being sloped downwardly from the seat toward the channel to direct such liquid flow to the channel; and the height of each of the inner and outer sidewall portions relative to the interior depth of the basin determined from the top edge to the lower base portion being such that the head can be supported within the interior of the basin by the elevated platform portion while the neck is supported by the seat substantially without discomfort to the person.

23. The basin of claim 22, including an outlet in fluid communication with the channel, the outlet being located on a section of the inner sidewall portion of the back end panel substantially adjacent the lower base portion, at least a section of the channel being sloped toward the outlet, the outlet being adapted for removing a liquid from the channel when liquid is present therein.

24. The basin of claim 23 including a drainage system releasably attached to the outlet and in fluid communication with the channel, and a section of the bottom edge of the outer sidewall portion opposing the outlet being notched upwardly sufficiently to define a passageway for extending the drainage system outwardly from the basin.

25. The basin of claim 23, wherein at least a section of the channel adjacent the outlet is recessed sufficiently to define a sump and the outlet is in fluid communication with the sump.

26. The basin of claim 22, wherein a continuous section of the bottom edge of the outer sidewall portion is stepped outwardly to provide a basin-stabilizing collar and the bottom edge includes a rim.

27. The basin of claim 22, wherein a section of the bottom edge of the outer sidewall portion of each of the opposing side panels is notched upwardly sufficiently to define a pair of opposing integral recessed hand gripping means each one determined from the notch upward to the top edge of the sidewall, the bottom edge includes a rim and the rim is outwardly and upwardly flared in each of the notched sections of the bottom edge to define a flange to thereby provide finger rest for each one of the defined hand gripping means.

28. A basin of claim 22, wherein the top edge of each side panel and the top edge of the back end panel is stepped downwardly to define a substantially flat ledge in substantially parallel relationship to the top edge, each of the inner sidewall portion and outer sidewall portion extending downwardly from each flat ledge relative to the bottom being respectively stepped inwardly and outwardly to each define a stop means such that the basin can be nested within another like basin, the stop means of one basin cooperating with a like complementary stop means defined on the top edge of the other basin to maintain each basin in parallel relationship to one another with an air space therebetween.

29. A substantially rectangular unitary contoured basin adapted for receiving and supporting a selected body part of a person for isolatably cleansing, treating and the like comprising:

a generally open-top pan having a bottom, its interior surface and exterior surface defined by a substantially continuous sidewall, the sidewall describing a pair of opposing side panels, a first end panel and an opposing second end panel, each panel being in continuous relationship with one another, the bottom, and the sidewall, the bottom comprising a lower base portion and an integral substantially rectangular elevated platform portion, the elevated platform portion having a top surface which is dimensionally sized to receive the selected body part thereon and support it above and away from contact with the lower base portion;

the sidewall comprising an inner sidewall portion, an outer sidewall portion and a top edge formed by joining the inner sidewall at its terminus to the outer sidewall portion, the inner sidewall portion of each one of the side panels, the first end panel and the second end panel extending substantially vertically from the bottom upwardly to a terminus at a height at least above that of the top surface of the elevated platform portion, the outer sidewall extending downwardly from the top edge and outwardly relative to the bottom, the outer sidewall portion terminating in a bottom edge and having a length sufficient to provide sideways stability to the basin;

the top edge of the first end panel having a seat defined by a notch on a section thereof configured for receiving and supporting an associated member of the selected body part of a person;

a section of a top edge of each side panel is stepped downwardly to define at least two ledges, a portion of each of the inner sidewall portion and outer sidewall portion extending downwardly from each of the ledges relative to the bottom respectively is stepped inwardly and outwardly to define at least two opposing stop means whereby the basin can be nested with a second like basin;

a section of the inner sidewall portion adjacent the lower base portion being in spaced relationship to the elevated platform portion such that the elevated platform portion, the section of the inner sidewall portion and the lower base portion cooperatively define a channel adapted to receive and hold a liquid; and the height of each of the inner and outer sidewall portions relative to an interior depth of the basin determined from the top edge to the lower base portion being such that the selected body part can be supported within the interior of the basin by the elevated platform portion while the associated member is concurrently supported by the seat substantially without discomfort to the person.

30. The basin of claim 29, wherein the seat has a substantially horizontal base cooperatively formed by laterally extending each of an inner sidewall portion and outer sidewall portion of the defined seat from a top edge relative to a bottom thereof to define a base having a lateral width greater than that of the top edge.

31. The basin of claim 29 having a second opposing seat defined on a section of the top edge of the second end panel, the second seat being of differing dimensional size and shape than the first seat.

32. The basin of claim 29, including an outlet in fluid communication with the channel located on a section of the inner sidewall portion of one of the side panels substantially adjacent the lower base portion, at least, a section of the channel being sloped toward the outlet, and the outlet being adapted for removal of a liquid from the channel when liquid is present therein.

33. The basin of claim 32, including a drainage system releasably attached in liquid-tight sealable relationship to the outlet and in fluid communication with the channel, and a section of the bottom edge of the outer sidewall portion positioned opposite the outlet being notched upwardly sufficiently to define a passageway for extending the drainage system outwardly from the basin.

34. The basin of claim 32, wherein at least a section of the lower base portion adjacent the outlet is recessed sufficiently to define a sump and the outlet is in fluid communication with the sump.

35. The basin of claim 29, wherein a continuous section of the bottom edge of the outer sidewall portion is stepped outwardly to provide a basin-stabilizing collar.

36. The basin of claim 29, wherein the bottom edge of the outer sidewall portion includes a rim, a section of a bottom edge of each one of the opposing side panels is notched upwardly to define a pair of integral recessed hand gripping means determined from the notch upwardly to the top edge, and the rim is outwardly and upwardly flared in the notched section to define a flange to thereby provide a finger rest.

37. The basin of claim 36, wherein a top edge of each defined integral hand gripping means is stepped downwardly to define a thumbhold.

* * * * *